US006834681B2

(12) United States Patent
Wahhoud

(10) Patent No.: US 6,834,681 B2
(45) Date of Patent: Dec. 28, 2004

(54) METHOD FOR CONTROLLING THE SHED IN A LOOM WITH MECHANICAL WEFT INSERTION

(75) Inventor: Adnan Wahhoud, Lindau (DE)

(73) Assignee: Staubli Faverges, Faverges (FR)

( * ) Notice: Subject to any disclaimer, the term of this patent is extended or adjusted under 35 U.S.C. 154(b) by 204 days.

(21) Appl. No.: 10/268,335

(22) Filed: Oct. 9, 2002

(65) Prior Publication Data

US 2003/0066569 A1 Apr. 10, 2003

(30) Foreign Application Priority Data

Oct. 10, 2001 (DE) ..... 101 49 969

(51) Int. Cl.[7] ..... D03C 13/00; G06F 19/00

(52) U.S. Cl. ..... 139/1 E; 139/59; 139/455; 700/140

(58) Field of Search ..... 139/1 E, 55.1, 139/57, 59, 85, 93, 11, 455; 700/140

(56) References Cited

U.S. PATENT DOCUMENTS 5,355,911 A * 10/1994 Kuster et al. ..... 139/55.1

5,743,305 A * 4/1998 Tamura et al. ..... 139/1 E

FOREIGN PATENT DOCUMENTS

| | | |
|---|---|---|
| EP | 0353005 | 1/1990 |
| EP | 0697477 | 2/1996 |

* cited by examiner

*Primary Examiner*—Peter Nerbun

(74) *Attorney, Agent, or Firm*—Dowell & Dowell, P.C.

(57) ABSTRACT

In a loom with a mechanical weft insertion the motion of each individual warp thread on its way from an uppermost position to a lowermost position and vice verse is controlled individually by a jacquard in such a way, that the motion profile includes a shed stopping in a weft entrance section and simultaneously in a weft exit section of a weaving width of the loom. Shed stopping is avoided in an intermediate section between the weft entrance and exit sections of the weaving width of a loom thereby providing sufficient time for the rapiers or grippers to be withdrawn from the shed without damaging the warp threads.

7 Claims, 3 Drawing Sheets

FIG.1
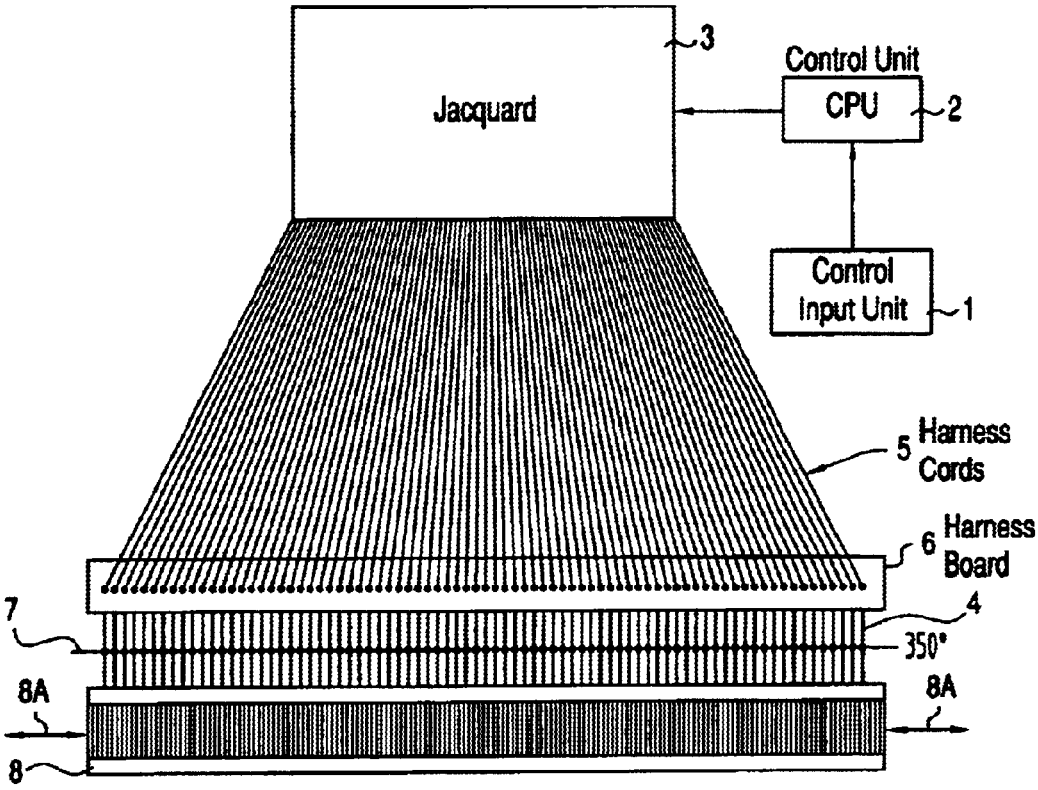
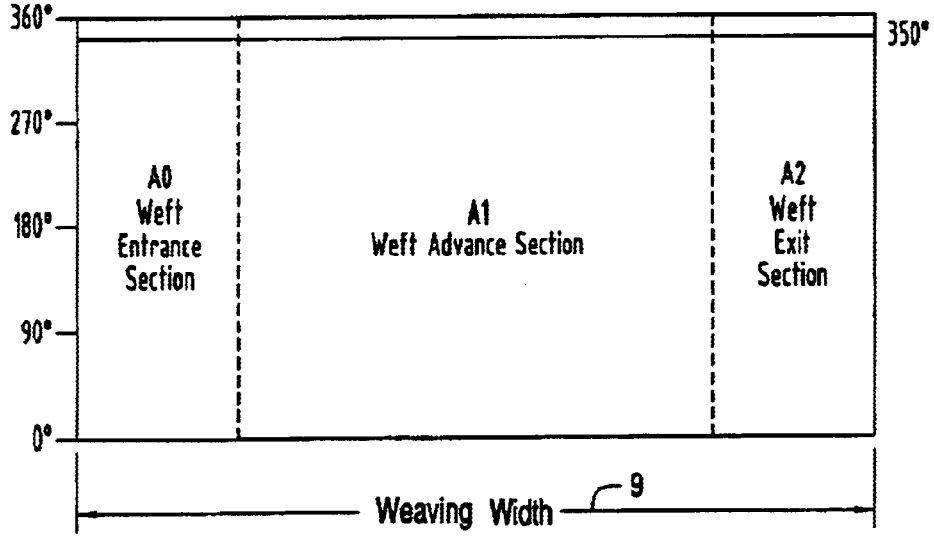
FIG.2

FIG.3
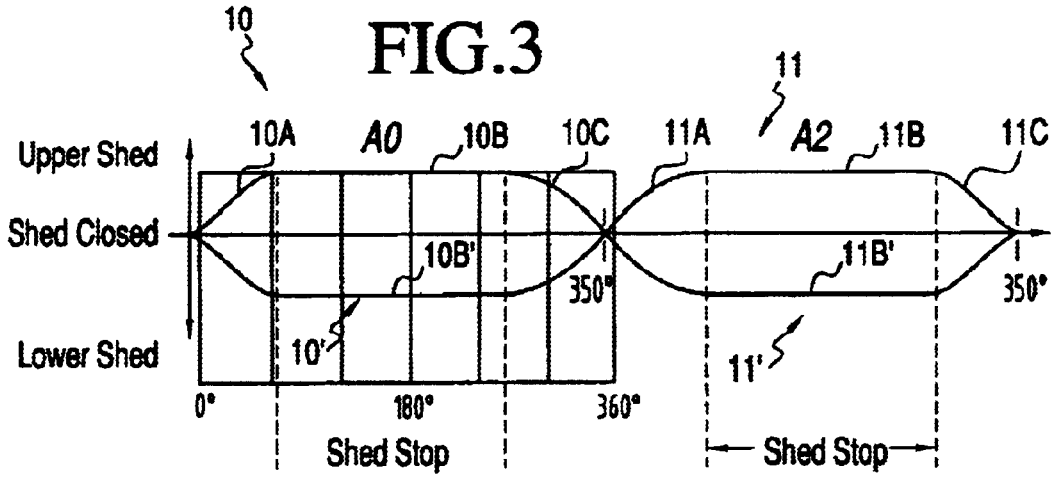
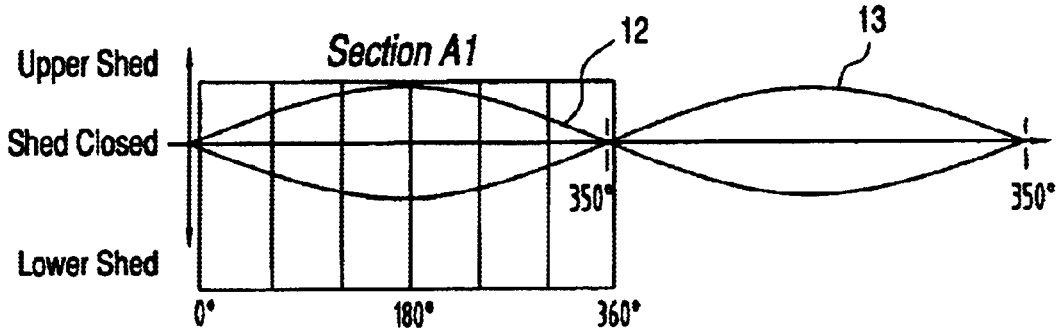
FIG.4
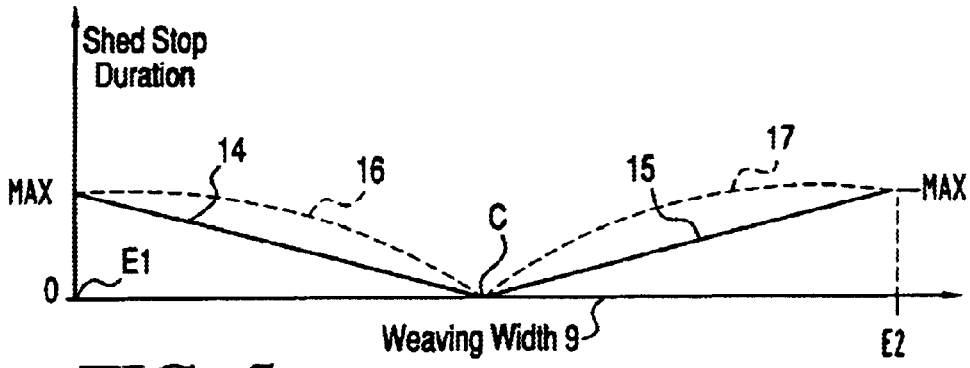
FIG. 5

METHOD FOR CONTROLLING THE SHED IN A LOOM WITH MECHANICAL WEFT INSERTION

CROSS-REFERENCE TO RELATED APPLICATION

This application Ser. No. 10/268,334 is related to U.S. Patent Application for: Method for Controlling the Shed in a Loom With Fluidic Weft Insertion; by the present inventor. The related application is filed concurrently with the present application. The entire disclosure of the related application is incorporated herein by reference.

PRIORITY CLAIM

This application is based on and claims the priority under 35 U.S.C. §119 of German Patent Application 101 49 969.8-26, filed on Oct. 10, 2001 in the Federal Republic of Germany. The entire disclosure of the German Patent Application is incorporated herein by reference.

FIELD OF THE INVENTION

The invention relates to a method for controlling the warp shed formation and warp shed closure with the aid of a jacquard that is part of a weaving loom. The weft threads are mechanically inserted into the open warp shed by grippers or so-called rapiers. One rapier is positioned at an entrance to the warp shed, the other rapier is positioned at an exit of the warp thread.

BACKGROUND INFORMATION

Weaving looms with a mechanical weft thread insertion for producing a fabric having a predetermined fabric pattern are operated in combination with a jacquard which controls the repeated shed formation of the warp threads. One weaving cycle includes an opening of a warp shed, an insertion of a weft thread into the warp shed and closing of the warp shed followed by a beat-up of the inserted weft by the reed against the fabric. A mechanical weft insertion by two grippers or rapiers requires a special attention to the shed formation to avoid damaging the warp threads by the rapiers as the rapiers are moved out of the shed which extends over the weaving width defined between the weft entrance and the weft exit of the warp shed. A jacquard of modern construction comprises a plurality of electrically or electronically controllable warp lifting and lowering components or drives which, for example, are driven by controllable electric motors. Such jacquards do not comprise any knives nor any drives for such knives.

Each warp thread of all warp threads in the loom is guided and driven by the jacquard operating components including harness cords, etc., which lift and lower the respective warp thread through coupling elements which connect the harness cords with respective drives and with heddles and pull back members to move each of the warp threads. Each harness cord and its pull back member are guided and driven by a respective individual operating component or drive motor in such a way that the warp shed is formed by the warp threads. For this purpose one group of warp threads is moved vertically from a first upper position to a second lower position while another group of warp threads is simultaneously vertically moved from the second lower position to the first upper position to thereby form the warp or loom shed. An electronic control or CPU is provided for the controlled motion of the warp threads for the shed formation and respective shed closure. The electronic control drives each of the warp operating components in accordance with a preselected program by transmitting signals from the control unit, for example, to the above mentioned individual electric motors for driving the warp threads.

European Patent Publication EP 0,353,005 B2 (Palmer) discloses an example of a weaving loom with a drive mechanism that performs the function of a jacquard as described above. Each individual warp thread is moved by its heddle and a respective heddle actuator between end positions which are variable in accordance with a fabric pattern representing program stored in the memory of a computer. The operation is such that a preselected pattern is formed in the textile being woven. The control data stored in the computer memory represent selected operating parameters that result in an "oblique or parabolic shedding" during the weaving operation.

The disclosure of the European Patent Publication EP 0,353,005 B2 does not provide for different shed formation configurations for different types of looms such as mechanical looms with a weft insertion by two rapiers or fluid jet looms with a fluidic weft insertion by fluid nozzles for transporting a weft thread through the warp or loom shed having an entrance and an exit. Thus, the shedding or the shed motion profiles for the same fabric pattern are identical, namely oblique or parabolic for a loom with mechanical weft insertion and for a loom with pneumatic weft insertion. The use of either oblique or parabolic shedding in any type of loom does not take into account that different types of looms have different shedding requirements for achieving an optimal weaving operation.

OBJECTS OF THE INVENTION

In view of the foregoing it is the aim of the invention to achieve the following objects singly or in combination:

- to control the shed motion profile or shedding in accordance with the requirements of a loom with a mechanical weft insertion;
- to control the motion of individual heddles in such a way that in a loom with a mechanical weft insertion by grippers or rapiers, the shed motion profile or shedding permits a safe insertion and withdrawal of the grippers or rapiers into and out of the weft insertion channel to thereby reduce damage to the warp threads;
- to provide an increased operational life for the components that operate the heddles including the warp pull back elements; and
- to reduce the wear and tear on the warp threads and of the heddle operating or heddle driving components and pull back elements to thereby increase the operational life of weaving looms with a mechanical weft insertion while gently handling or driving the warp threads for the shed formation.

SUMMARY OF THE INVENTION

The above objects have been achieved according to the invention by a method which takes shedding requirements of a loom with mechanical weft insertion into account for operating the individual heddles in a heald shaft in response to electronic control data or respective signals stored in a computer memory. The data for individually controlling the lifting and lowering of the warp threads take into account a safe timing for the withdrawal of the weft inserting rapiers along a weft entrance section and along a weft exit section of the weaving width of the loom. According to the invention the driving of the individual heddles depends on the instantaneous angular rotational position of a main loom drive shaft in such a manner that a shed stop is assured simultaneously in the weft entrance section of the warp shed being formed and in the weft exit section of such a shed when the maximum shed opening occurs and further so that a shed stop is avoided simultaneously in a weft advance section or at least in a center of the shed between the shed entrance section and the shed exit section. In the entrance and exit sections the shed motion profile has a distinct shed stop between rising and falling curve portions. Preferably, the shed formation or motion profile without a shed stop at least at the shed center in the intermediate section between the entrance and exit sections is so controlled that the shedding motion resembles a sinusoidal curve or profile.

More specifically, according to the present method the following steps are performed:

(a) dividing a given weaving width of the weaving loom into at least three sections including a weft entrance section A0, a weft advance section A1, and a weft exit section A2, (b) mechanically inserting each weft thread into the warp shed, (c) generating reference signals based on angular degrees of rotation of a main loom drive shaft in each weaving cycle, (d) providing separate heddle motion control signals for each of a plurality of individually controllable heddle drives, and (e) controlling each of the heddle drives by separate heddle motion control signals in response to the reference signals so that in the weft entrance sections A0 and in said weft exit section the warp shed is temporarily stopped when said warp shed is in its maximally open position, and so that simultaneously a shed stop is avoided at least at a center of the weft advance section or in the center of the shed when the shed is maximally open.

The shed formation according to the invention treats each individual warp thread more gently compared to the forces that are applied to the warp threads in a conventional shed formation.

As a result, the invention substantially reduces warp breakage with a corresponding reduction in the interruptions of the weaving process that conventionally occur. Additionally, the operating or drive components for the individual heddles and the heddles themselves including warp thread holders, such as an eye or a hook in each heddle, are also subject to lesser forces as compared to the prior art, thereby reducing wear and tear as well as excess swing motions of the individual warp threads.

BRIEF DESCRIPTION OF THE DRAWINGS

In order that the invention may be clearly understood, it will now be described in connection with example embodiments, with reference to the accompanying drawings, wherein:

FIG. 1 shows schematically components of a loom with a mechanical weft insertion and a shed forming jacquard controlled according to the method of the invention;

FIG. 2 illustrates along the abscissa at least three sections of a weaving width of a loom with a mechanical weft insertion, whereby the ordinate shows the angle of rotation of the main loom drive shaft;

FIG. 3 illustrates discontinuous curves representing the warp motion or shedding profile with a shed stop in the entrance and exit sections of the loom shed whereby the ordinate shows the shed formation while the abscissa shows degrees of rotation of the main loom drive shaft;

FIG. 4 illustrates the continuous shed motion or shedding profile in the intermediate section between the entrance and exit sections of the shed or rather the weaving width, without any shed stop;

FIG. 5 illustrates a shed stop duration plotted along the ordinate as a function of the weaving width.

Figure 6:
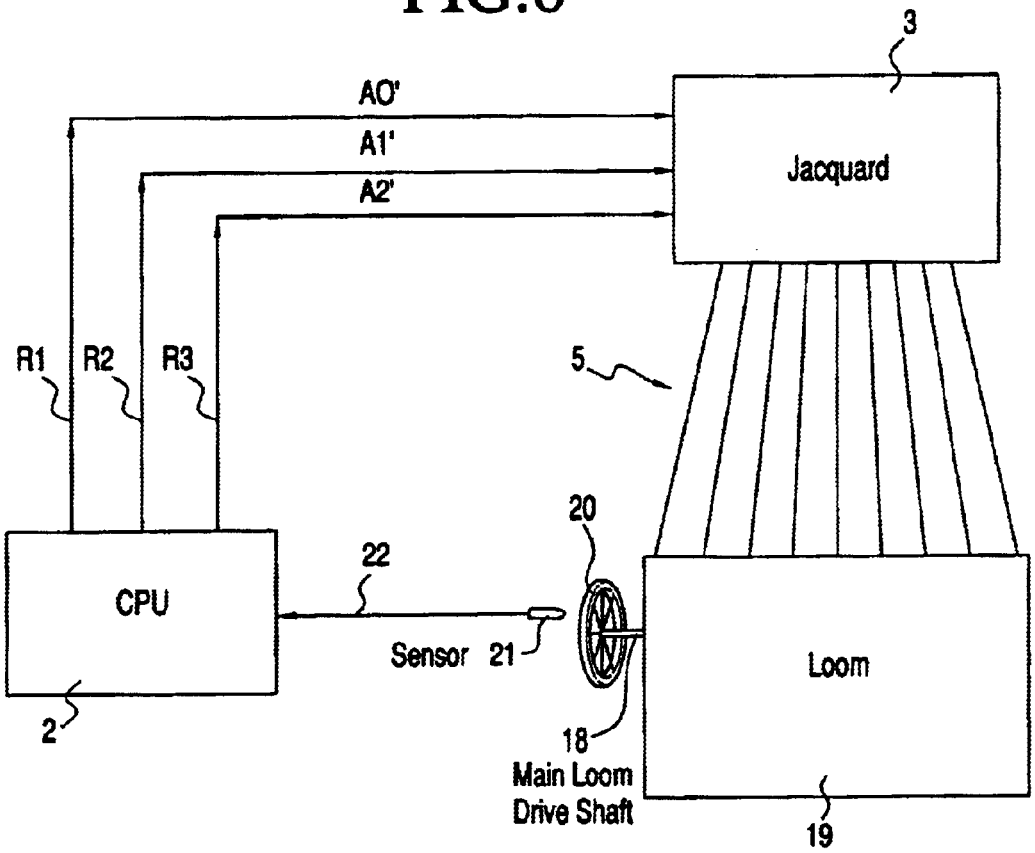
FIG. 6 shows a block circuit diagram for generating a reference signal based on the angular degrees of rotation of the main loom drive shaft.

DETAILED DESCRIPTION OF PREFERRED EXAMPLE EMBODIMENTS AND OF THE BEST MODE OF THE INVENTION

FIG. 1 shows a schematic arrangement of the loom components required for explaining the invention. A control data input unit such as a keyboard 1 is operatively connected to a central processing and control unit 2 which in turn is operatively connected to a jacquard 3 that individually controls the lifting and lowering of heddles 4 through respective harness cords 5. The harness cords 5 run through a harness board 6 and move the heddles 4 including warp holders 7, for example in the form of heddle hooks or heddle eyes for the shed formation simply referred to as shedding. At least one warp thread runs through each heddle eye 7.

In FIG. 1 all heddle eyes 7 are shown in a position along a horizontal line representing 350° of rotation of a loom main drive shaft shown symbolically in FIG. 6 to be described below. A reed 8 performs a conventional weft beat-up motion, when the shed is entirely closed at 350° of one revolution of the main loom drive shaft as indicated by a dotted horizontal line in FIG. 1. Double arrows 8*a* at the entrance and exit of the loom shed formed by the warp threads, indicate conventional mechanical weft inserting members such as rapiers or the like but excluding weft insertion nozzles.

FIG. 2 shows that according to the invention a weaving width 9 and thus the shed of the loom is divided into a plurality of sections including at least a weft entrance section A0, an intermediate weft advance section A1, and a weft exit section A2. The ordinate in FIG. 2 represents the 360° of one revolution of the main loom drive shaft. The horizontal line designated by 350° of such rotation corresponds to the dotted line shown in FIG. 1 and indicates the shed closure.

FIG. 3 represents an instant motion profile of the warp threads or rather of the shedding in the weft entrance section A0 and in the weft exit section A2. The heddle eyes 7 assume positions along the curves shown in FIG. 3. Curves 10 and 11 show the motion profile of the upper shed. Curves 10' and 11' show the motion profile of the lower shed. Each curve 10 and 11 has a rising portion 10A, 11A, a horizontal shed stop portion 10B, 11B and a falling portion 10C, 10C. The curves 10' and 11' of the respective lower shed are mirror-symmetric to the respective curves 10 and 11. Along the horizontal curve portions 10B, 11B, 10B', 11B', the shed is temporarily stopped simultaneously in the entrance and exit sections A0 and A2. This type of shed stopping in the entrance and exit sections of the shed provides extra time for the removal of the weft inserting grippers or rapiers from the loom or warp shed at both ends of the weaving width, whereby damage to the warp threads by the grippers or rapiers is reduced or even eliminated. The shed is completely closed at 350° of shaft rotation.

FIG. 4 shows the motion profile or shedding of the warp threads in the intermediate section A1, whereby the profiles follow a sinusoidal curve configuration 12 and 13 without any shed stopping in the intermediate section A1. Shed closing takes place at 350° of shaft rotation as in FIG. 3. It has been found that shed stopping is unnecessary in the intermediate section A1 because the sinusoidal configurations of the shed motion profiles provide sufficient time for the rapiers to withdraw at least into the entrance and exit sections A0 and A2 where the shed stopping facilitates further rapier withdrawal.

FIG. 5 shows a shed stopping time duration or characteristic according to the invention as a function of the weaving width 9. At the center C of the weaving width 9 there is no shed stopping. The shed stopping however increases from zero at the center C to a maximum MAX at the entrance E1 and at the exit E2 of the loom shed. Prolonging the shed stop time toward the entrance E1 and exit E2 provides sufficient time for withdrawing both rapiers 8A, shown in FIG. 1, from the loom shed without damage to the warp threads by the rapiers. The stopping time increase may be linear as shown at 14 and 15 or the stopping time increase may follow a curve such as a sinusoidal curve portion shown at 16 and 17.

FIG. 6 shows a block diagram for generating reference signals that represent the angles of rotation of the main drive shaft 18 of the loom 19. The angle information is produced by a strobe generator 20. A sensor 21 feeds strobe pulses on a conductor 22 to an input of the central control 2 also shown in FIG. 1. The central control 2 generates at least three separate reference signals R1, R2, R3 that are supplied to the jacquard 3 at three different inputs A0', A1' and A2' which are allocated to the respective weaving width sections A0, A1 and A2.

The central control 2 correlates or synchronizes the control signals for operating the individual harness cords 5 with the reference signals. Thus, the respective heddles and accordingly the corresponding warp threads are moved up or down or stopped precisely at the intended angular position of the main loom drive shaft 18 as illustrated in FIGS. 3, 4 and 5.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for controlling the formation and closure of a warp shed in a weaving loom having a mechanical waft insertion, a main loom drive shaft and a given weaving width, said weaving loom further including a plurality of heddles and a respective plurality of individually controllable heddle drives, so that each heddle has its own heddle drive, said method comprising the following steps:

(a) dividing said given weaving width of said weaving loom into at least three sections including a weft entrance section (A0), a weft advance section (A1), and a weft exit section (A2), (b) mechanically inserting each weft thread into said warp shed, (c) generating reference signals based on angular degrees of rotation of said main loom drive shaft in each weaving cycle, (d) providing separate heddle motion control signals for each of said individually controllable heddle drives, and (e) individually controlling each of said heddle drives by said separate heddle motion control signals in response to said reference signals so that in said weft entrance section (AO) and in said weft exit section said warp shed is stopped when said warp shed is in a maximally open position, and so that simultaneously a shed stop is avoided at least at a center of said weft advance section in said maximally open position of said warp shed.

2. The method of claim 1, comprising applying said separate heddle motion control signals so that stopping said loom shed is avoided entirely along said weft advance section of said weaving width.

3. The method of claim 1, comprising applying said separate heddle motion control signals so that a time duration of a shed stop is zero at a center of said weft advance section (A1), and so that said shed stop time duration increases from said center of said weft advance section (A1) toward a weft entrance and toward a weft exit.

4. The method of claim 3, wherein said controlling step is performed so that said shed stopping time duration reaches its maximum in said weft entrance section and in said weft exit section.

5. The method of claim 1, comprising applying said separate heddle motion control signals as a function of said angular degrees of rotation of said main loom drive shaft, so that in said weft entrance section (A0) and in said weft exit section (A2) a shedding motion assumes a position along a curve that has a rising curve portion followed by a flat curve portion followed by a dropping curve portion and vice versa, and wherein said flat curve portion signifies a shed stop.

6. The method of claim 1, wherein said controlling causes in said weft advance section (A1) first a rising heddle motion curve toward a center of said weft advance section (A1) and then a falling heddle motion curve from said center toward said weft exit section (A2).

7. The method of claim 6, wherein said rising and falling heddle motion curve approximates a sinusoidal wave form.

* * * * *